US009246279B2

(12) United States Patent
Kato et al.

(10) Patent No.: US 9,246,279 B2
(45) Date of Patent: Jan. 26, 2016

(54) ELECTRIC CONNECTOR

(71) Applicant: ACES ELECTRONICS CO., LTD., Zhongli, Taoyuan County (TW)

(72) Inventors: Nobukazu Kato, Fussa (JP); Yohei Zama, Atsugi (JP)

(73) Assignee: Aces Electronics Co., Ltd., Zhongli (TW)

( * ) Notice: Subject to any disclaimer, the term of this patent is extended or adjusted under 35 U.S.C. 154(b) by 0 days.

(21) Appl. No.: 14/301,902

(22) Filed: Jun. 11, 2014

(65) Prior Publication Data

US 2014/0370749 A1 Dec. 18, 2014

(30) Foreign Application Priority Data

Jun. 14, 2013 (JP) ..... 2013-125555

(51) Int. Cl.

| | |
|---|---|
| ***H01R 12/00*** | (2006.01) |
| ***H01R 13/6596*** | (2011.01) |
| ***H01R 12/57*** | (2011.01) |
| ***H01R 12/71*** | (2011.01) |
| ***H01R 12/73*** | (2011.01) |
| ***H01R 13/6597*** | (2011.01) |

(52) U.S. Cl.

CPC ..... *H01R 13/6596* (2013.01); *H01R 9/096* (2013.01); *H01R 12/57* (2013.01); *H01R 12/716* (2013.01); *H01R 12/73* (2013.01); *H01R 13/6597* (2013.01)

(58) Field of Classification Search

CPC .. H01R 13/65807; H01R 9/096; H01R 12/57; H01R 12/716

USPC ..... 439/607.31, 74, 101, 108

See application file for complete search history.

(56) References Cited

U.S. PATENT DOCUMENTS

| | | | | |
|---|---|---|---|---|
| 4,762,500 | A * | 8/1988 | Dola | H01R 23/688 439/101 |
| 5,116,230 | A * | 5/1992 | Dechelette | H01R 23/688 439/101 |
| 5,413,491 | A * | 5/1995 | Noschese | H01R 23/688 439/108 |
| 5,645,436 | A * | 7/1997 | Shimizu | H01R 23/688 439/108 |
| 5,813,871 | A * | 9/1998 | Grabbe et al. | 439/108 |
| 6,250,935 | B1 * | 6/2001 | Mochizuki | H01R 23/6873 439/108 |
| 6,338,635 | B1 * | 1/2002 | Lee | 439/108 |

(Continued)

FOREIGN PATENT DOCUMENTS

JP 4333884 B2 9/2009

*Primary Examiner* — Neil Abrams
*Assistant Examiner* — Travis Chambers
(74) *Attorney, Agent, or Firm* — Chiesa Shahinian & Giantomasi PC

(57) ABSTRACT

Provided is an electric connector, including: a housing placed on a circuit board and including a receiving concave portion formed by a substantially square-cylindrical-shaped inner wall surface and receiving a mating connector, and a center convex portion disposed between a pair of opposed walls forming the receiving concave portion; a plurality of terminals accommodated in a plurality of terminal grooves formed in each of the pair of the opposed walls; and a ground metal fitting connecting with a plate-shaped ground plate included in the mating connector, wherein the housing includes a space accommodating the ground metal fitting, where the space is disposed in the central area between the pair of the opposed walls and extends in the arrangement direction of the terminals, the upper part of the space communicates with an opening formed in the center convex portion, and receives the mating ground plate.

4 Claims, 7 Drawing Sheets

(56) References Cited

U.S. PATENT DOCUMENTS 6,648,657 B1 * 11/2003 Korsunsky ..... H01R 13/65807 439/108
6,884,094 B1 * 4/2005 Bernhart et al. ..... 439/101
6,981,898 B2 * 1/2006 Akama ..... H01R 23/688 439/108
6,984,137 B2 * 1/2006 Akasaka et al. ..... 439/108
7,585,185 B2 * 9/2009 Obikane ..... 439/607.01
8,083,527 B2 * 12/2011 Takeuchi ..... H01R 13/26 439/65
8,858,239 B2 * 10/2014 Little ..... H01R 13/28 439/74
2002/0115318 A1 * 8/2002 Apicelli ..... H01R 13/6585 439/108
2006/0089018 A1 * 4/2006 Orita ..... H01R 12/57 439/74
2008/0214051 A1 9/2008 Obikane

* cited by examiner

ELECTRIC CONNECTOR

CROSS-REFERENCE TO RELATED APPLICATIONS

This application claims priority to Japanese Patent Application No. 2013-125555, filed on Jun. 14, 2013, which is incorporated herein by reference in its entirety.

BACKGROUND OF THE INVENTION

The present invention related to an electric connector mounted on a circuit board and connected with a mating connector. There is a type of electric connector provided with a shell around a housing of the electric connector. This shell prevents noise from being mixed into electric signals so as to remove noise effect on the electric signals.

According to the electric connector of this type, ground terminals connected with a ground pattern of the circuit board are only provided at the four corners and the respective centers of both sides of the shell. In this case, electric signals are easily subjected to noise effect when transmitted via terminals not given ground terminals nearby.

SUMMARY OF THE INVENTION

It is an object of the invention to provide an electric connector capable of removing noise effect on electric signals transmitted at high speed.

An electric connector of the invention includes: a housing placed on a circuit board and including a receiving concave portion formed by a substantially square-cylindrical-shaped inner wall surface and receiving a mating connector, and a center convex portion disposed between a pair of opposed walls forming the receiving concave portion; a plurality of terminals accommodated in a plurality of terminal grooves formed in each of the pair of the opposed walls, and contacting mating terminals of the mating connector; and a ground metal fitting connecting with a plate-shaped ground plate included in the mating connector, wherein the housing includes a space accommodating the ground metal fitting, which space is disposed in the central area between the pair of the opposed walls and extends in the arrangement direction of the terminals, the upper part of the space communicates with an opening formed in the center convex portion, extending in the arrangement direction of the terminals, and receiving the mating ground plate, the ground metal fitting includes a first connecting portion extending in the arrangement direction of the terminals, a second connecting portion extending in the arrangement direction of the terminals, and a connecting portion connecting the first connecting portion and the second connecting portion on the circuit board side such that the first connecting portion and the second connecting portion face to each other, and each of the lower ends of the first connecting portion and the second connecting portion is mounted on the circuit board.

Further, in the electric connector of the invention, the cross-sectional shape of the space of the housing in a direction crossing the arrangement direction of the terminals is a convex shape, the first connecting portion of the ground metal fitting is an elastic portion bended along a first inner wall forming the convex space, and the second connecting portion of the ground metal fitting is an elastic portion bended along a second inner wall forming the convex space.

Further, in the electric connector of the invention, each of the first connecting portion and the second connecting portion includes cut portions formed at predetermined intervals in the arrangement direction of the terminals.

According to the electric connector of the invention, noise effect on electric signals transmitted at high speed is removed.

DETAILED DESCRIPTION OF THE INVENTION

Figure 1:
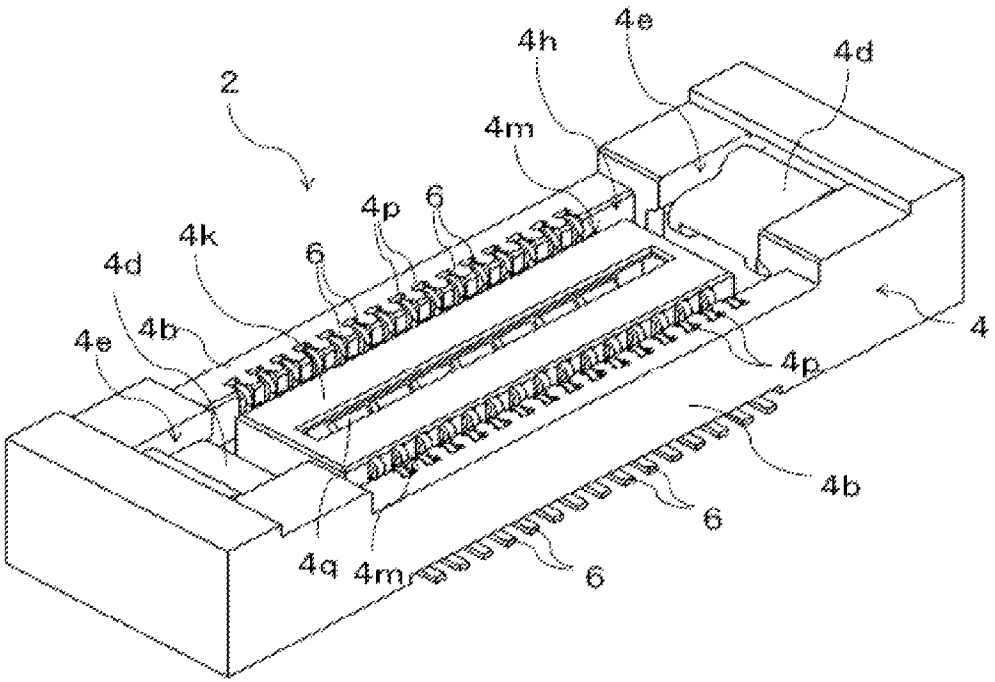
FIG. 1 is a perspective view of a receptacle connector according to an embodiment.
Figure 2:
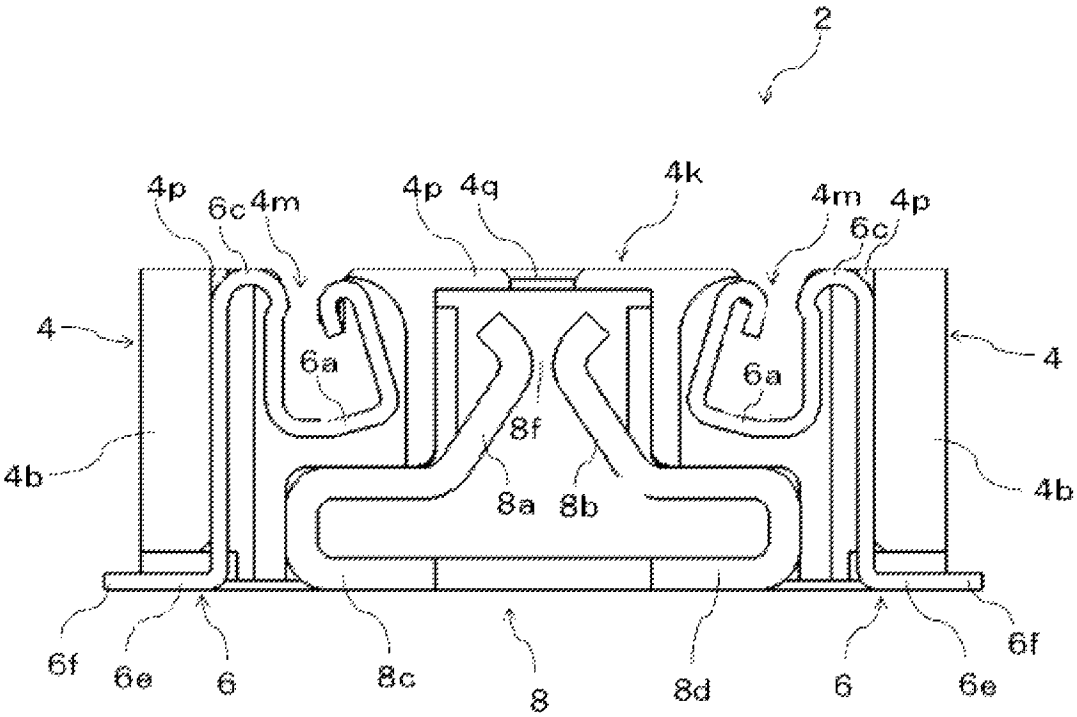
FIG. 2 is a cross-sectional view of the receptacle connector according to the embodiment.
Figure 3:
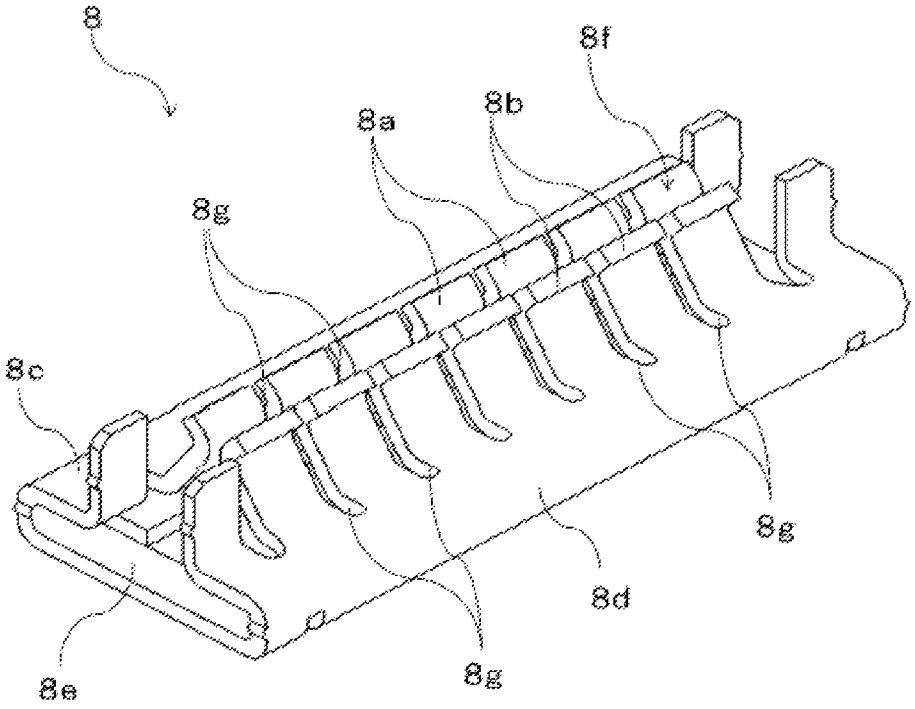
FIG. 3 is a perspective view of a ground metal fitting according to the embodiment.

An electric connector according to an embodiment of the invention is hereinafter described with reference to the drawings. FIG. 1 is a perspective view illustrating a receptacle connector (electric connector) according to this embodiment. FIG. 2 is a cross-sectional view of FIG. 1. FIG. 3 is a perspective view illustrating a ground metal fitting disposed inside the receptacle connector.

As illustrated in FIG. 1, the receptacle connector 2 includes a housing 4 having a rectangular shape in the plan view. The housing 4 is made of insulating material. Side walls 4*b* are provided at both ends of the housing 4 in the short direction, and extended in the longitudinal direction of the housing 4. Accommodating portions 4*e* are provided at both ends of the housing 4 in the longitudinal direction. Each of the accommodating portions 4*e* receives and accommodates a lock metal fitting 4*d*. The lock metal fitting 4*d* is a metal fitting which prevents separation of a plug connector 10 (see FIG. 4) from the receptacle connector 2 after the plug connector 10 is fitted to the receptacle connector 2.

A receiving concave portion 4*h* is formed at the center of the housing 4. The receiving concave portion 4*h* has a substantially square cylindrical shape surrounded by the inner wall surfaces of the side walls 4*b* and the accommodating portions 4*e*. The receiving concave portion 4*h* is configured to receive the plug connector 10. A center convex portion 4*k* is provided at the center of the receiving concave portion 4*h*. The center convex portion 4*k* extends in the longitudinal direction of the housing 4.

A receptacle fitting groove 4*m* is formed between the center convex portion 4*k* and one of the side walls 4*b*. The receptacle fitting groove 4*m* extends in the longitudinal direction of the housing 4. The receptacle fitting groove 4*m* is similarly formed between the center convex portion 4*k* and the other side wall 4*b*. This receptacle fitting groove 4*m* also extends in the longitudinal direction of the housing 4.

As illustrated in FIG. 2, a space is formed below the center convex portion 4*k*. The space has a convex cross-sectional shape, and extends in the longitudinal direction of the housing 4. The space is positioned in the central area between the one side wall 4*b* and the other side wall 4*b*. The upper part of the space communicates with a rectangular opening 4*q* formed at the center of the center convex portion 4*k*. A ground metal fitting 8 illustrated in FIG. 3 is disposed within the space. The ground metal fitting 8 extends in the longitudinal direction of the housing 4.

A plurality of terminal grooves 4*p* is formed on the inner wall surface side of the one side wall 4*b* at predetermined intervals. The terminal grooves 4*p* accommodate and hold corresponding terminals 6. Each of the terminals 6 accommodated and held in the terminal grooves 4*p* has a substantially S shape. A curved portion 6*a* is positioned within the receptacle fitting groove 4*m*, while a folded portion 6*c* is positioned at the upper end of the one side wall 4*b*. A lower end 6*e* is connected to the circuit board by soldering. A tip portion 6*f* of the lower end 6*e* is exposed to the outside of the one side wall 4*b*.

Similarly, a plurality of the terminal grooves 4*p* for accommodating and holding the terminals 6 are formed on the inner wall surface side of the other side wall 4*b* at predetermined intervals. Each of the terminals 6 accommodated and held in the terminal grooves 4*p* of the other side wall 4*b* similarly has a substantially S shape. The curved portion 6*a* is positioned within the receptacle fitting groove 4*m*, while the folded portion 6*c* is positioned at the upper end of the other side wall 4*b*. The lower end 6*e* is connected to the circuit board by soldering. The tip portion 6*f* of the lower end 6*e* is exposed to the outside of the other side wall 4*b*.

The ground metal fitting 8 includes a first connecting portion 8*a* disposed on the one side wall 4*b* side, and a second connecting portion 8*b* disposed on the other side wall 4*b* side. The first connecting portion 8*a* is connected with a ground plate 16 (see FIG. 5). The second connecting portion 8*b* is positioned opposed to the first connecting portion 8*a*, and connected with the ground plate 16 (see FIG. 5). A first base bottom portion 8*c* positioned beneath the first connecting portion 8*a* and a second base bottom portion 8*d* positioned beneath the second connecting portion 8*b* are connected by connecting portions 8*e* formed at both ends of the ground metal fitting 8 in the longitudinal direction.

The first connecting portion 8*a* is an elastic member which includes a bended portion positioned at the upper end of the first connecting portion 8*a* and bended toward the second connecting portion 8*b*, and an inclined portion inclined downward toward the first base bottom portion 8*c* from the bended portion. Similarly, the second connecting portion 8*b* is an elastic member which includes a bended portion positioned at the upper end of the second connecting portion 8*b* and bended toward the first connecting portion 8*a*, and an inclined portion inclined downward toward the second base bottom portion 8*d* from the bended portion.

A plurality of cut portions 8*g* are formed in the first connecting portion 8*a* at predetermined intervals. The cut portions 8*g* extend downward from the upper end of the first connecting portion 8*a*. Similarly, a plurality of the cut portions 8*g* are formed in the second connecting portion 8*b* at predetermined intervals. The cut portions 8*g* extend downward from the upper end of the second connecting portion 8*b*. A clearance 8*f* is formed between the bended portion of the first connecting portion 8*a* and the bended portion of the second connecting portion 8*b*. The clearance 8*f* extends in the arrangement direction of the terminals 6.

The entire lower surface of the first base bottom portion 8*c* and the entire lower surface of the second base bottom portion 8*d* are connected with the ground pattern of the circuit board.

Figure 4:
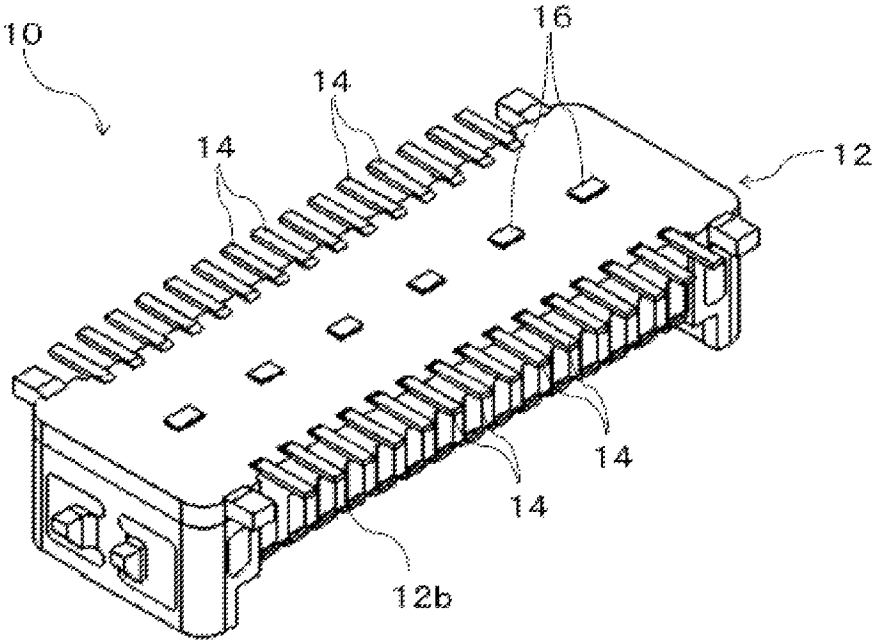
FIG. 4 is a perspective view of a plug connector according to the embodiment.
Figure 5:
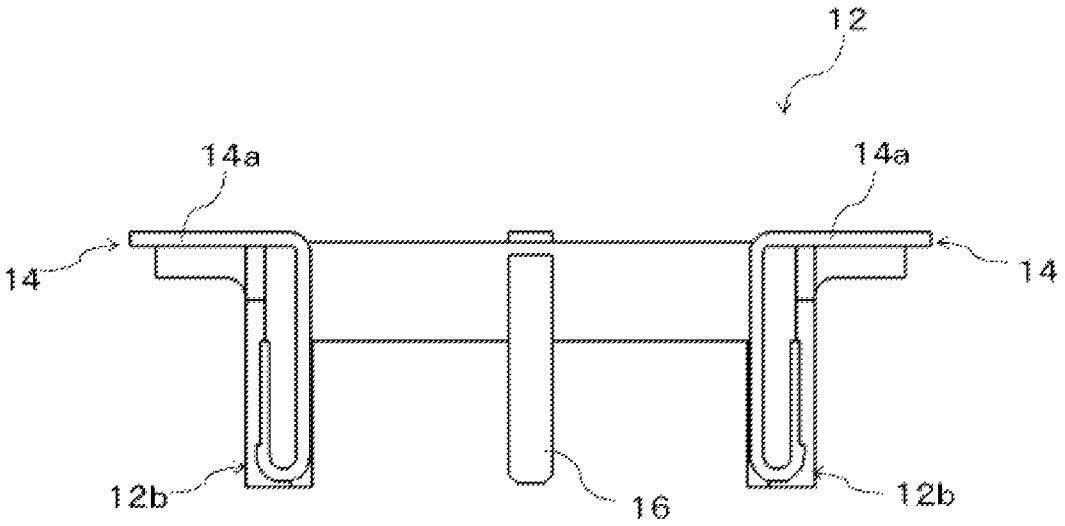
FIG. 5 is a cross-sectional view of the plug connector according to the embodiment.

FIG. 4 is a perspective view illustrating the plug connector (mating connector) according to this embodiment. FIG. 5 is a cross-sectional view of FIG. 4. As can be seen from FIG. 4, the plug connector 10 includes a rectangular housing 12 made of insulating material. Side walls 12*b* are provided at both ends of the housing 12 in the short direction. The side walls 12*b* extend in the longitudinal direction of the housing 12. Mating terminals 14 are arranged at predetermined intervals along the side walls 12*b*. As illustrated in FIG. 5, the ground plate 16 formed by insert molding is provided at the center of the housing 12. The ground plate 16 is a one-piece plate which extends in the longitudinal direction of the housing 12.

Each of the mating terminals 14 arranged on the one side wall 12*b* side has a substantially L shape. An upper end 14*a* of each of the mating terminals 14 on the one side wall 12*b* side is connected with a circuit pattern of a not-shown mating circuit board by soldering. Similarly, each of the mating terminals 14 arranged on the other side wall 12*b* side has a substantially L shape. The upper end 14*a* of each of the mating terminals 14 on the other side wall 12*b* side is connected with the circuit pattern of the not-shown mating circuit board by soldering.

Figure 6:
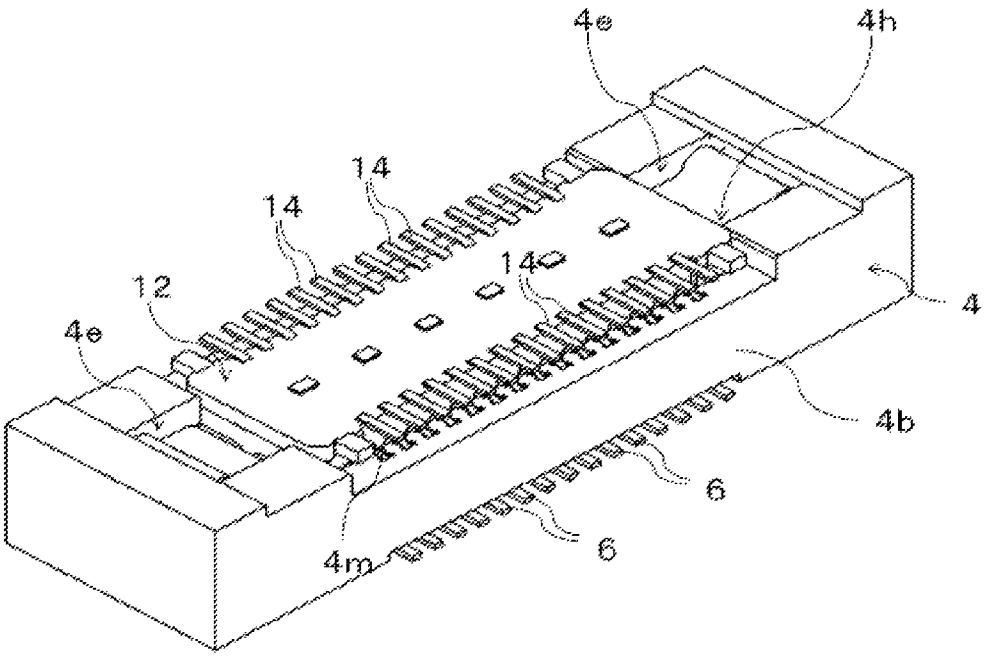
FIG. 6 is a perspective view illustrating a condition of the receptacle connector and the plug connector fitted to each other according to the embodiment.
Figure 7:
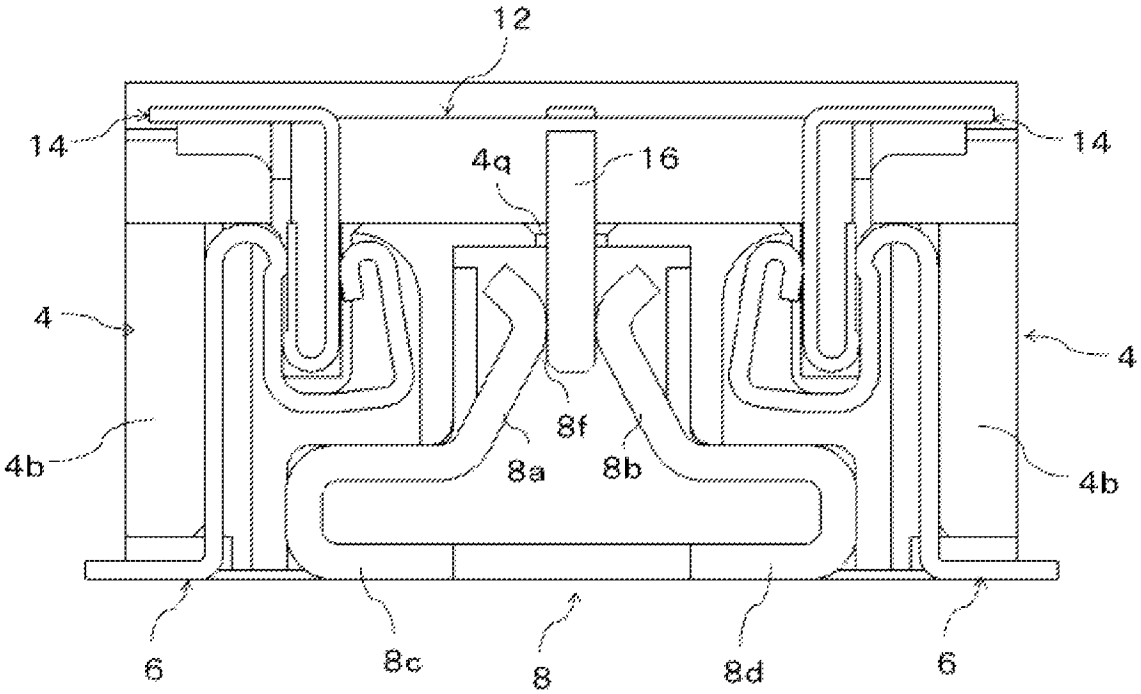
FIG. 7 is a cross-sectional view illustrating the condition of the receptacle connector and the plug connector fitted to each other according to the embodiment.

FIG. 6 is a perspective view illustrating a condition of the receptacle connector 2 and the plug connector 10 fitted to each other according to this embodiment. FIG. 7 is a cross-sectional view of FIG. 6. When fitted to the receptacle connector 2, the plug connector 10 is received by the receiving concave portion 4*h* of the receptacle connector 2 as illustrated in FIG. 6.

More specifically, electric connection between the mating terminals 14 and the terminals 6 is established by the fits between the one side wall 12*b* and the one receptacle fitting groove 4*m* and between the other side wall 12*b* and the other receptacle fitting groove 4*m*.

Simultaneously, the ground plate 16 is inserted through the opening 4*q* of the center convex portion 4*k* into the clearance 8*f* of the ground metal fitting 8. In this case, the first connecting portion 8*a* is constantly urged by an elastic force toward the right as viewed in FIG. 7, while the second connecting portion 8*b* is constantly urged by an elastic force toward the left as viewed in FIG. 7. Accordingly, the first connecting portion 8*a* and the second connecting portion 8*b* come into contact with the ground plate 16 by a sufficient contact force.

According to the receptacle connector 2 in this embodiment, the ground metal fitting 8 extended in the arrangement direction of the terminals 6 is positioned at the center of the housing 4. In this condition, the entire lower surface of the first base bottom portion 8*c* and the entire lower surface of the second base bottom portion 8*d* are both brought into continuous connection with the ground pattern of the circuit board. This structure can locate the ground metal fitting 8 close to all the terminals 6 at substantially the same distances from the respective terminals 6, and therefore can eliminate noise effect on electric signals transmitted via the respective terminals 6 at high speed.

Moreover, the cut portions 8*g* formed in each of the first connecting portion 8*a* and the second connecting portion 8*b* can produce uniform contact between the first and second connecting portions 8*a* and 8*b* and the ground plate 16.

The embodiment described herein has been presented for the purpose of easy understanding of the invention only, and is not intended to limit the scope of the invention. It should therefore be appreciated that the respective elements disclosed in this embodiment include all changes in design and equivalents without departing from the technical scope of the invention.

The invention claimed is:

1. An electric connector, comprising:

a housing placed on a circuit board and including a receiving concave portion formed by a substantially square-cylindrical-shaped inner wall surface and receiving a mating connector, and a center convex portion disposed between a pair of opposed walls forming the receiving concave portion;

a plurality of terminals accommodated in a plurality of terminal grooves formed in each of the pair of the opposed walls, and contacting mating terminals of the mating connector; and a ground metal fitting connecting with a plate-shaped ground plate included in the mating connector;

wherein the center convex portion includes a faced surface facing to the mating connector, the housing includes an internal space accommodating the ground metal fitting, which internal space is disposed on inside of the center convex portion and extends in the arrangement direction of the terminals, the upper part of the internal space communicates with an opening formed in the faced surface, extending in the arrangement direction of the terminals, and receiving the mating ground plate, the ground metal fitting includes a first connecting portion extending in the arrangement direction of the terminals, a second connecting portion extending in the arrangement direction of the terminals, and a connecting portion connecting the first connecting portion and the second connecting portion on the circuit board side such that the first connecting portion and the second connecting portion face each other, and each of the lower ends of the first connecting portion and the second connecting portion is mounted on the circuit board.

2. The electric connector of claim 1, wherein each of the first connecting portion and the second connecting portion includes cut portions formed at predetermined intervals in the arrangement direction of the terminals.

3. The electric connector of claim 1, wherein the cross-sectional shape of the internal space of the housing in a direction crossing the arrangement direction of the terminals is a convex shape;

the first connecting portion of the ground metal fitting is an elastic portion bent along a first inner wall forming the internal space of the convex shape; and the second connecting portion of the ground metal fitting is an elastic portion bent along a second inner wall forming the internal space of the convex shape.

4. The electric connector of claim 3, wherein each of the first connecting portion and the second connecting portion includes cut portions formed at predetermined intervals in the arrangement direction of the terminals.

* * * * *